United States Patent [19]

Williams et al.

[11] Patent Number: 5,054,158

[45] Date of Patent: Oct. 8, 1991

[54] SCRUBBING MACHINE/VACUUM CLEANER

[76] Inventors: William H. Williams, 4936 Golden Arrow Dr., Rancho Palos Verdes, Calif. 90274; Paul G. Jacobs, 9958 Amestoy Ave., Northridge, Calif. 91324

[21] Appl. No.: 625,968

[22] Filed: Dec. 11, 1990

[51] Int. Cl.[5] ..... A47L 5/34

[52] U.S. Cl. ..... 15/354; 15/320; 15/340.1; 15/353; 15/385

[58] Field of Search ..... 15/354, 320, 340.1, 15/340.3, 327.2, 353, 385

[56] References Cited

U.S. PATENT DOCUMENTS

| | | | |
|---|---|---|---|
| 3,290,716 | 12/1966 | Cain | 15/320 X |
| 3,739,417 | 6/1973 | Sawyer | 15/320 X |
| 3,833,961 | 9/1974 | Fortman et al. | 15/320 X |
| 3,886,624 | 6/1975 | Landesman et al. | 15/354 X |
| 3,942,218 | 3/1976 | Krier et al. | 15/340.3 |

*Primary Examiner*—Chris K. Moore
*Attorney, Agent, or Firm*—Joseph E. Mueth

[57] ABSTRACT

A scrubbing machine/vacuum cleaner which is carried by two spaced-apart front wheels and two spaced-apart rear wheels, having affixed to and extending from the front of the machine a cleaning head and brush assembly which is adapted to ride in proximity to, but in spaced-apart relationship from, the surface to be cleaned when all four wheels are resting on the surface to be cleaned. During actual cleaning operation, the head and brush assembly is adapted to press on the surface to be cleaned when the two rear wheels are raised from the surface to be cleaned. The front wheel assembly comprises a cross-member forming part of the frame carrying the machine, the cross-member having swivelably mounted thereto an axle. The axle carries the front wheels at its ends whereby the cleaning head is kept flat on the floor during the cleaning operation as the machine rolls over irregularities in the surface to be cleaned.

4 Claims, 4 Drawing Sheets

SCRUBBING MACHINE/VACUUM CLEANER

BACKGROUND OF THE INVENTION

Vacuum cleaners and wet extraction machines are wellknown. One type with which this invention is concerned relates to cleaning machines which are carried on four wheels and are adapted to be pushed from place to place and then tipped forward at the point of use to cause the cleaning head assembly affixed to the front of the machine to abut the surface to be cleaned. The problem is that oftentimes the floor on which the machine rides is irregular which causes the cleaning head to intermittently be lifted up and away from the floor so that there is a loss of vacuum action, viz., suction applied to the floor surface to be cleaned, results in incomplete and spotty cleaning.

In an attempt to cope with this problem, various costly and complicated suspension systems for the cleaning head assembly have been proposed which are intended to keep the cleaning head in abutting relationship to the floor as surface irregularities are encountered. These suspension systems are costly to manufacture, are subject to fouling and disablement and, in any case, do not solve the problem.

The present invention presents a simple, low cost, new and novel approach to overcoming these difficulties, and it is believed that the present invention will be rapidly recognized by those skilled in the cleaning machine art.

BRIEF SUMMARY OF THE INVENTION

Briefly, the present invention comprises an improved scrubbing machine/vacuum cleaner.

More particularly, this invention concerns a scrubbing machine/vacuum cleaner which is carried by two spaced-apart front wheels and two spaced-apart rear wheels, having affixed to and extending from the front of the machine a vacuum cleaning head and brush assembly which is adapted to ride in proximity to, but in spaced-apart relationship from, the surface to be cleaned and during actual cleaning operation is adapted to press on the surface to be cleaned; the improvement which comprises a novel front wheel assembly comprising a cross-member forming part of the frame carrying the machine, the cross-member having swivelably-mounted thereto an axle, the axle carrying said front wheels at its ends whereby said cleaning head is kept flat on the floor during the cleaning operation as the machine rolls over irregularities in the surface to be cleaned.

It is an object of this invention to provide a novel scrubbing machine/vacuum cleaner.

It is a specific object of this invention to provide an improved scrubbing machine/vacuum cleaner whenever the cleaning head assembly is kept flat on the floor in abutting relationship thereto as the machine is pushed over irregular floor surfaces.

A related object of this invention is a novel suspension system for the two front wheels of a four-wheel, mounted scrubbing/vacuum cleaner machine.

These and other objects and advantages of this invention will be apparent from the more detailed description which follows in conjunction with the accompanying drawings.

DESCRIPTION OF THE PREFERRED EMBODIMENT

The structure of four-wheel, mounted cleaning machines in relation to the chassis, vacuum motor and lines, filters, dirt collection units and cleaning head assembly including rotatable brushes are known and need not be described herein in detail. The drawings are directed to those novel features which make up the present invention.

Turning to the drawings.

Figure 1:
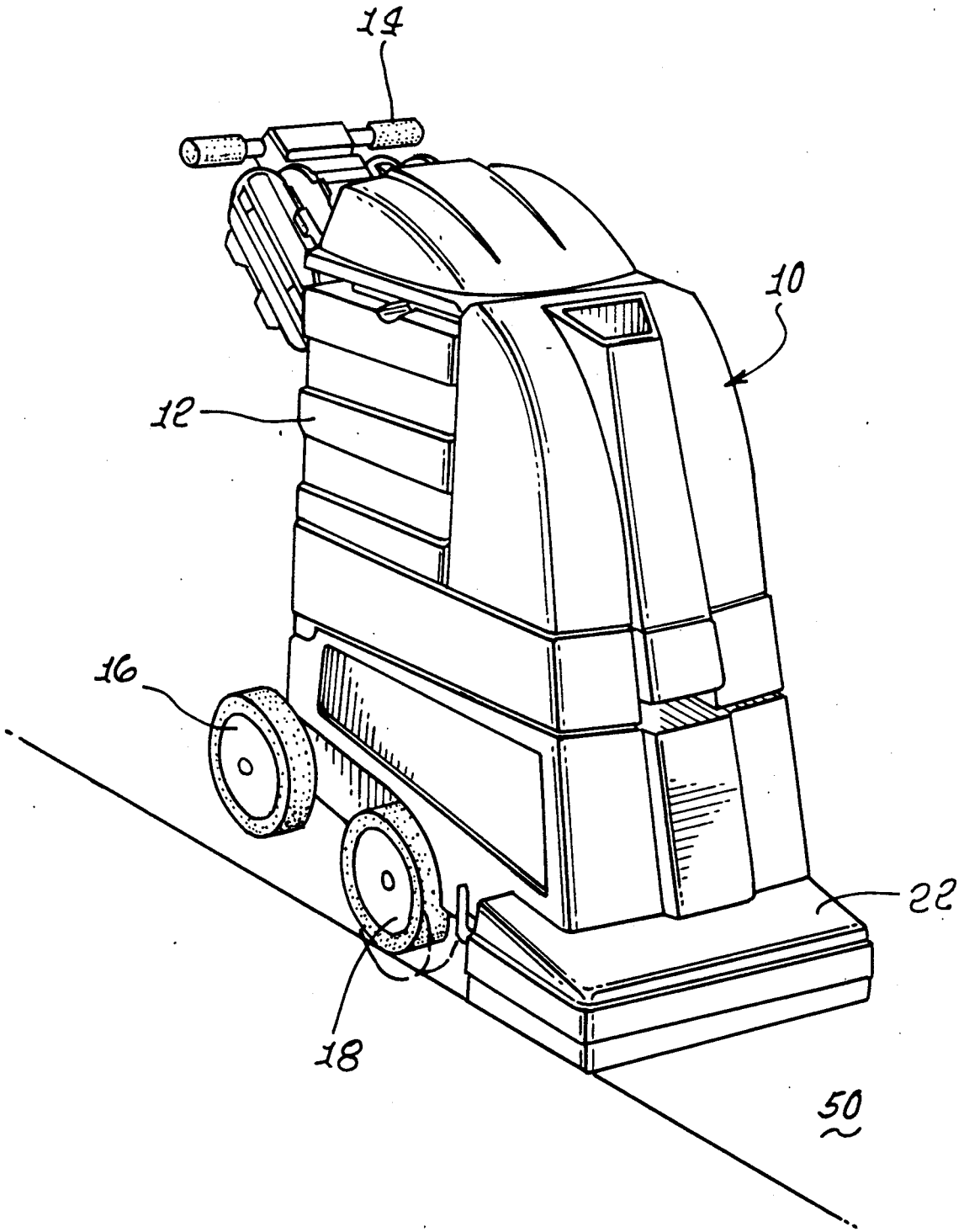
FIG. 1 is a perspective view from the right front of a cleaning machine/vacuum cleaner having the swivel front wheel suspension according to this invention.
Figure 2:
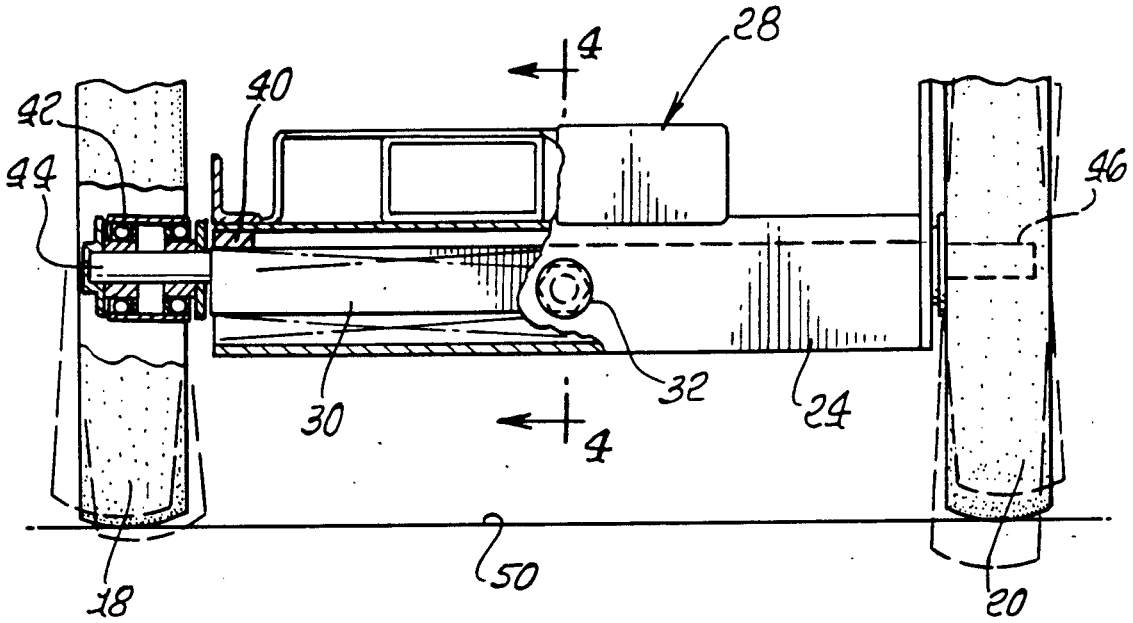
FIG. 2 is a front view of the swivel assembly in partial breakaway view.
Figure 5:
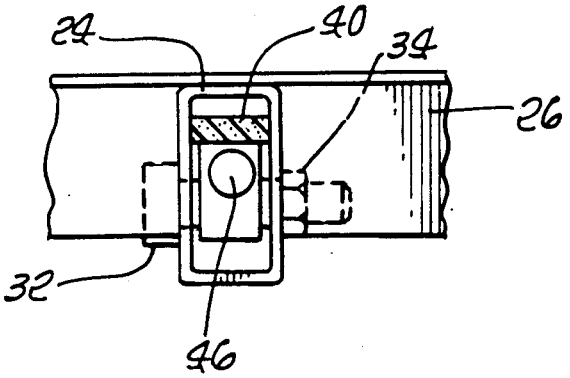
FIG. 5 is an end view of the swivel assembly of this invention.
Figure 4:
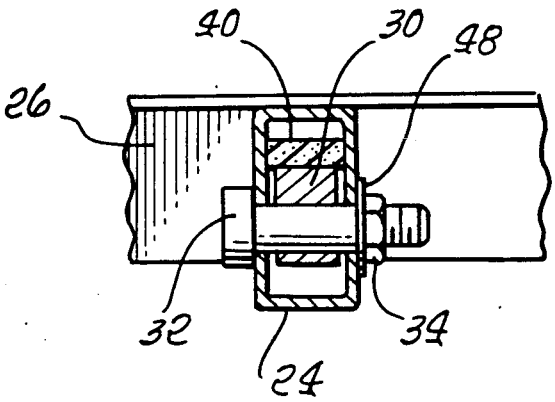
FIG. 4 is a sectional view taken along line 4—4 in FIG. 2.
Figure 3:
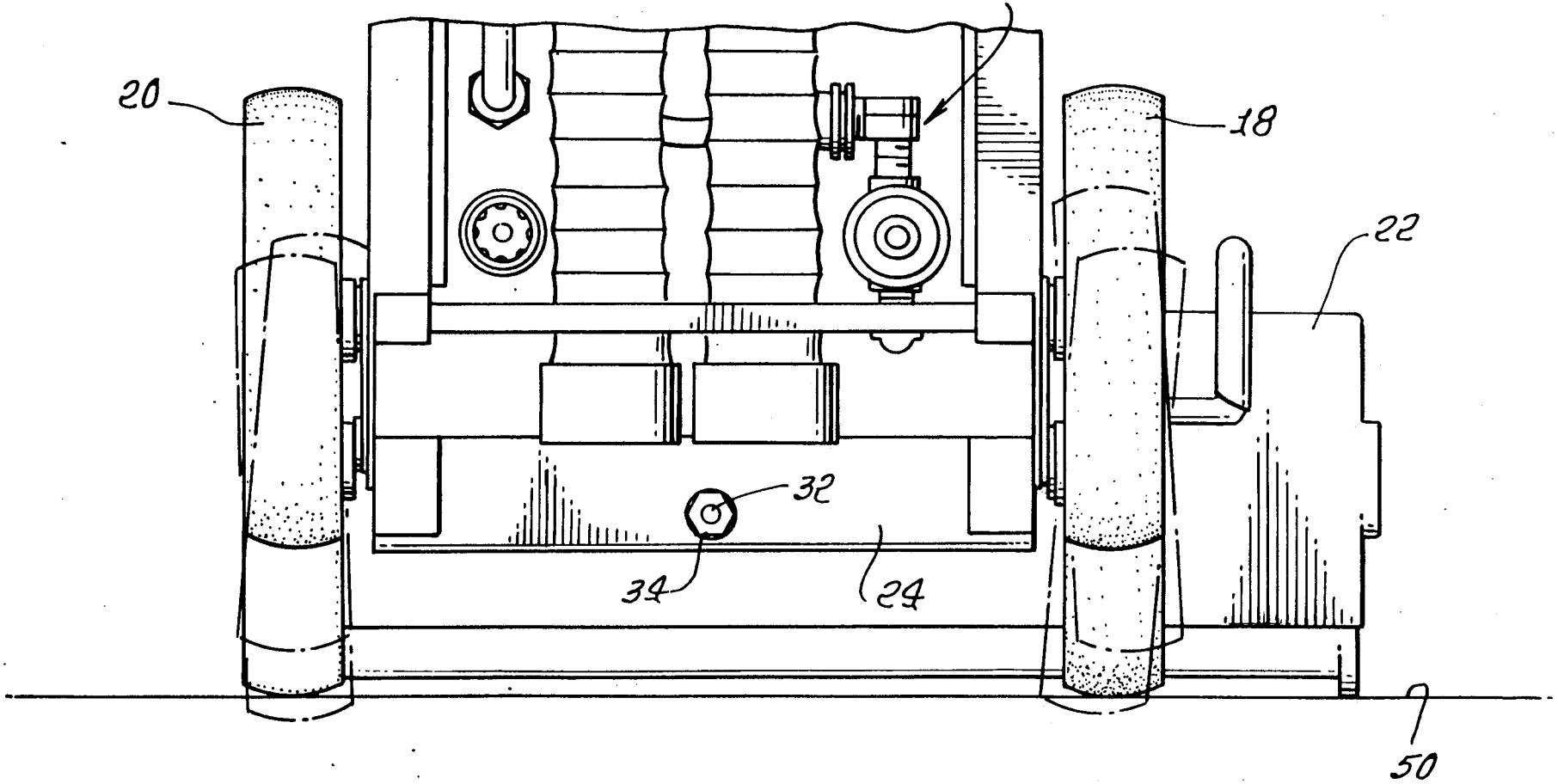
FIG. 3 is a rear view of the structure shown in FIG. 2.
Figure 6:
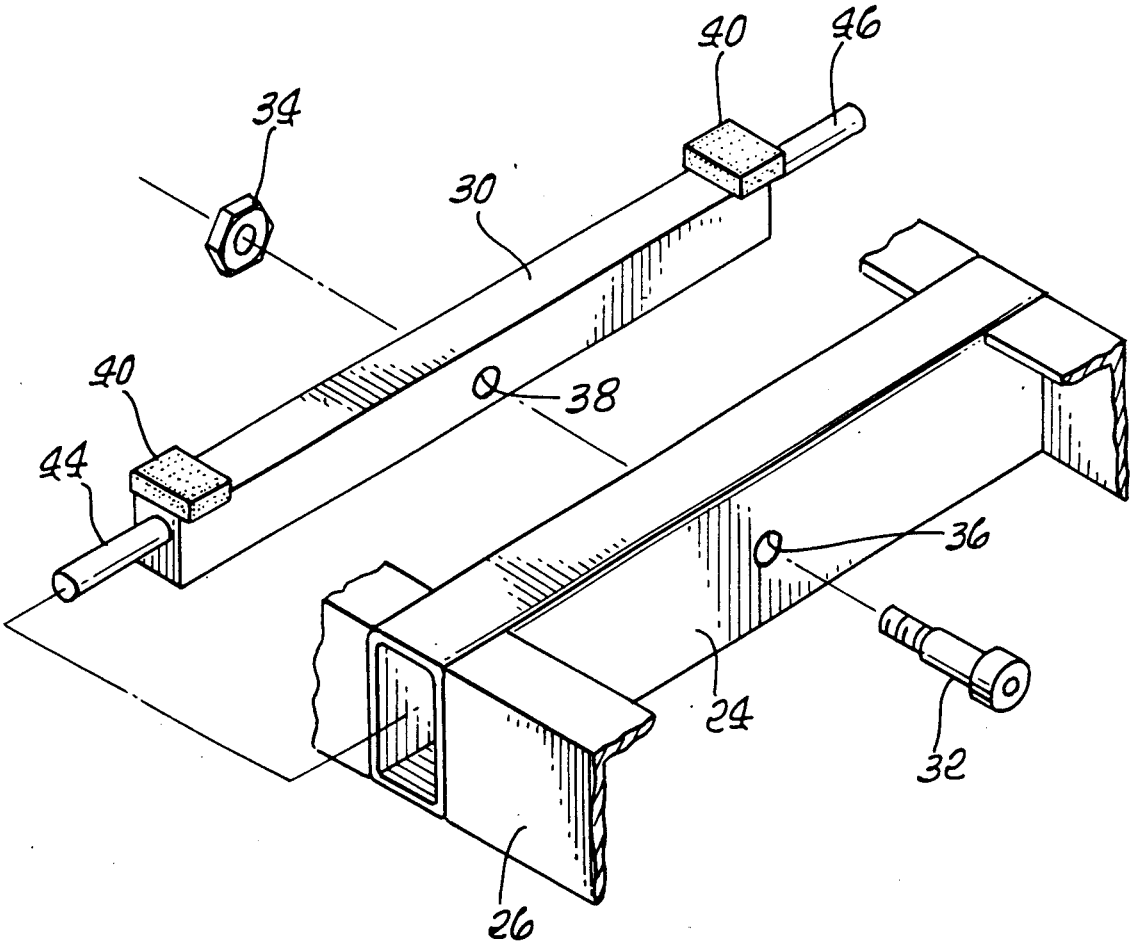
FIG. 6 is a perspective view of the swivel front wheel suspension with the parts being exploded and separated to aid in illustration.

Considering the drawings in more detail, the machine which embodies the invention has an upper body 10 which carries removable water tanks 12 and handles 14 at the top rear. The upper body encloses the vacuum motor which is carried on a frame chassis by the four wheels.

Rear wheels 16 are rotatably connected to the machine, but are otherwise fixed in that they cannot move up and down relative to the rest of the machine. Front wheels 18 and 20 can move relative to the rest of the machine as is explained below.

The structure of the upper portion of the machine shown in the drawings is more fully disclosed in copending U.S. Pat. Application Ser. No. 07/514,094, filed Apr. 25, 1990, the disclosure of which is incorporated herein by reference.

It is also understood that this invention is applicable to cleaning and vacuum machines generally, and is not limited by the drawings or the disclosure of the cited pending patent application.

The vacuum cleaning head and brush assembly 22 extends from the front of the machine and is normally raised up slightly from the floor surface when all four wheels are resting on the floor. In use, as shown in FIG. 1, rear Wheels 16 are raised off the floor when the operator lifts up on handles 14. Simultaneously, head and brush assembly 22 is brought down to rest on the floor surface in abutting relationship. At this point, the weight of the machine rests on front wheels 18 and 20 and on vacuum head and brush assembly 22.

In the preferred embodiment, the swivel front suspension includes a box-like cross-member 24 which forms an integral part of main frame 26 which carries all of the electrical and mechanical components, generally designated 28, of machine 10. Axle 30 is loosely received within cross-member 24 and is swivelably retained therein by bolt 32 and nut 34, bolt 32 passing through hole 36 in cross-member 24 and through hole 38 in axle 30. The relative sizing of interior cross-member 24 is such that axle 30 can move up and down, viz., swivel or seesaw, within cross-member 24 and bolt 32.

The outer, upper extremities of axle 30 are provided with resilient, normally elastomeric bumpers 40 which prevent noise clicking or banging when axle 30 rotates at either end to its upper limit within cross-member 24. Bumpers 40 at that moment come into contact with the upper inside surface of cross-member 24. Bumpers 40 also serve as shock absorbers.

Wheels 18 and 20 are provided with conventional bearing assemblies 42 and are carried by axle shafts 44 and 46, respectively, which are affixed to axle 30. Nut 34 is secured by a washer.

In operation, the operator lifts up on handles 14 as machine 10 is pushed across the surface to be cleaned. Vacuum cleaner head 22 rides on floor 50. As irregular surfaces are encountered, wheels 18 and 20 move up or down, as the case may be, without disturbing the abutment of vacuum cleaning head 22. The structure of this invention is simple and foolproof in operation and is relatively low cost to produce. In addition, it is not prone to malfunction due to the accumulation of dirt or other causes.

Having fully described the invention, it is intended that it be limited solely by the lawful scope of the appended claims.

What is claimed is:

1. In a scrubbing machine/vacuum cleaner which is carried by two spaced-apart front wheels and two spaced-apart rear wheels, having affixed to and extending from the front of the machine a vacuum cleaner head and brush assembly which is adapted to ride in proximity to, but in spaced-apart relationship from, the surface to be cleaned and during actual cleaning operation is adapted to press on the surface to be cleaned when the two rear wheels are raised from the surface to be cleaned; the improvement which comprises a novel front wheel assembly comprising a cross-member forming part of the frame carrying the machine, the cross-member having swivelably mounted thereto an axle, the axle carrying said front wheels at its ends whereby said cleaning head is kept flat on the floor during operation as the machine rolls over irregularities in the surface to be cleaned.

2. The device of claim 1 w-herein said axle is centrally swivelably mounted within said cross-member.

3. The device of claim 1 wherein said axle has at the top of each of its ends resilient bumpers/shock absorbers.

4. The device of claim 1 wherein said axle is loosely received within said cross-member.

* * * * *